United States Patent [19]

Tambor et al.

[11] Patent Number: 4,737,156

[45] Date of Patent: Apr. 12, 1988

[54] FABRIC TREATMENT WITH A COMPOSITION COMPRISING A CELLULOSE GRAFT COPOLYMER

[75] Inventors: Martin Tambor, High Point; Jerry L. Cope, Mocksville; John L. Jerome, Coolemee, all of N.C.

[73] Assignee: National Starch and Chemical Corporation, Bridgewater, N.J.

[21] Appl. No.: 923,377

[22] Filed: Oct. 27, 1986

[51] Int. Cl.[4] ..... D06P 5/00; D06P 5/02

[52] U.S. Cl. ..... 8/490; 8/442; 8/495; 8/532; 8/543; 8/582; 8/586; 8/606; 8/918; 8/922; 8/924; 8/927; 8/917

[58] Field of Search ..... 8/442, 490, 562, 606, 8/554, 495

[56] References Cited

U.S. PATENT DOCUMENTS

| | | | |
|---|---|---|---|
| 4,131,576 | 12/1978 | Iovine et al. | 527/312 |
| 4,247,476 | 1/1981 | Haase et al. | 252/8.8 |
| 4,464,523 | 8/1984 | Neigel et al. | 527/300 |
| 4,547,574 | 10/1985 | Dvorsky et al. | 544/336 |
| 4,583,989 | 4/1986 | Ueda et al. | 8/543 |
| 4,599,087 | 7/1986 | Heller et al. | 8/495 |

*Primary Examiner*—A. Lionel Clingman

*Attorney, Agent, or Firm*—Edwin M. Szala; Ellen T. Dec; Lori D. Tolly

[57] ABSTRACT

Cationic cellulose graft copolymers obtained by the graft polymerization of a cellulose substrate and a cationic monomer are useful as textile treatment agents, especially as dye enchancers. As pretreatment agents, they improve dye yield, dye levelness and dye fastness properties and as after-treatment agents, they improve dye fastness and crock resistance properties.

26 Claims, No Drawings

FABRIC TREATMENT WITH A COMPOSITION COMPRISING A CELLULOSE GRAFT COPOLYMER

BACKGROUND OF THE INVENTION

This invention relates to the dyeing of textile fabrics.

The selection of dyes for a particular textile substrate textiles fiber or fabric has typically been governed primarily by the ability of the substrate to accept the dye.

Cationic quaternary ammonium compounds and polymers have been employed as textile finishing agents to enhance the dyeability of various textile substrates. Polymeric reaction products of ditertiary amines and dihalides found useful as textile assistants are described in U.S. Pat. No. 4,247,476 (issued Jan. 27, 1981 to J. Haase et al.). Cationic heterocyclic compounds containing at least one cellulose reactive group (halohydrin or epoxide group) are described as useful finishing agents in U.S. Pat. No. 4,547,574 (issued Oct. 15, 1985 to D. Dvorsky et al.). Polymeric compounds obtained by the reaction of epihalohydrin with a polyalkylene polyamine are taught to be useful as pretreatment or after-treatment dyeing agents in U.S. Pat. No. 4,599,087 (issued July 8, 1986 to J. Heller et al.).

There is a need for other useful dye enhancers which can provide a range of textile substrates with the ability to achieve permanent and level dye add on. There is also a need for a means of providing textile substrates with the ability to be apparel dyed.

It is therefore an object of the present invention to provide useful textile dye enhancers which provide fabrics treated therewith with permanent and level dye add on.

It is also an objective to provide a textile dye enhancer which can be used to provide a fabric with the capability to be overdyed.

It is also an objective to provide a textile dye enhancer which provides improved dye exhaustion resulting in more efficient and economical use of a dye or dye mixture with less waste.

Another objective is to provide an economical means for providing cellulosic or other inherently anionic textile substrates with the ability to be acceptably dyed employing dye classes known to be more economical due to their ease of application or cost (e.g. anionic dyes) but which have previously provided unsatisfactory results.

Another objective is to provide a process for treating textile fabrics which may be subsequently apparel dyed.

SUMMARY OF THE INVENTION

The above-mentioned and related objects are achieved in accordance with the process of the present invention which comprises treating a textile substrate before, during or after dyeing with a cationic cellulose graft copolymer prepared by reaction of a cellulose substrate and a cationic monomer.

Graft copolymers of hydroxyethyl cellulose and an N,N-diallyl-N,N-dialkyl ammonium salt are particularly useful as dye enhancers in the present invention.

By practicing the present invention, a number of advantages in the art are achieved. For instance, treatment of textile substrates with the cationic cellulose graft copolymer provides textiles which exhibit improved dye add-on as well as improved dye levelness and wash-fastness. The amount of time necessary to dye a treated substrate is also significantly shorter than that required for untreated substrates. Also improved dye exhaustion of the dye bath is observed during the dyeing of the treated substrates herein. Another advantage of the present invention includes providing unacceptably dyed textile substrates with the ability to be redyed or overdyed after treatment with the cationic cellulose graft copolymer in order to obtain a substrate with improved dye properties.

DESCRIPTION OF THE PREFERRED EMBODIMENTS

The useful dye enhancers of the present invention are cationic cellulose graft copolymers.

Regarding conventional cellulose derivatives, the substituents which are reacted with and added to the cellulose backbone are of low molecular weight, e.g. carboxymethyl, aminoalkyl, etc. Consequently, the product of the reaction is a highly substituted cellulose containing many substituents of low molecular weight, often one or more substituents per anhydroglucose unit (AGU).

Cellulose graft copolymers are vastly different in chemical structure from conventional cellulose derivatives. In a cellulose graft copolymer, a water solution of monomer is polymerized to give substituents which are of high molecular weight (usually more than 10,000) and which are very infrequently spaced along the cellulose backbone (usually more than 500 AGU separating each polymeric substituent). Methods for preparing graft copolymers of polysaccharides including cellulose are well known in the literature. See, for example, "Block and Graft Copolymerization", Vol. 1, ed. R. J. Ceresa, ed., John Wiley and Sons (1973).

Useful cellulose substrates herein include cellulose and its derivatives such as, for example, the hydroxyethyl, hydroxypropyl, methyl, ethyl, carboxymethyl and carboxymethylhydroxyethyl derivatives. Hydroxyethyl cellulose is preferably employed.

Any cationic-containing monomer may be grafted onto the cellulose substrate and employed herein. The preferred class of useful cationic-containing monomers are those having the formula:

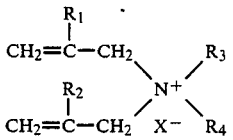

wherein $R_1$ and $R_2$ are independently a hydrogen or an alkyl group of 1 to 3 carbon atoms, preferably hydrogen; $R_3$ and $R_4$ are independently hydrogen, a phenyl, or a linear or branched alkyl group of from 1 to 16, preferably 1 to 4 carbon atoms; and X is an anion, preferably a halogen or alkyl sulfate.

X may be any anion in the above formula. Examples include halogen (e.g., Cl or Br), sulfate, sulfonate, phosphate, hydroxide, borate, sulfite, bisulfite, nitrate, nitrite, acetate, and other common inorganic and organic ions.

Particularly useful cationic-containing monomers of the above-described class are the N,N-diallyl-N,N-dialkyl ammonium salts, preferably N,N-diallyl-N,N-dimethyl ammonium chloride or bromide. Examples of other useful monomers include N,N-diallyl-N,N-diethyl ammonium chloride or bromide; N,N-diallyl-N-methyl-N-dodecylammonium chloride or bromide; N,N-diallyl-N-methyl-N-butylammonium chloride or bromide; N,N-diallyl-N-methyl-N-octylammonium chloride or bromide; and N,N-diallyl-N-methyl-N-decylammonium chloride or bromide.

Other classes of useful cationic-containing monomers include those having the formula:

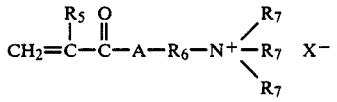

wherein A is —O— or —NH—; $R_5$ is hydrogen or an alkyl group of from 1 to 3 carbon atoms; $R_6$ is a straight or branched alkylene or hydroxyalkylene of from 1 to 12 carbon atoms, preferably 1 to 3 carbon atoms; $R_7$ is a phenyl or an alkyl group of from 1 to 3 carbon atoms, preferably methyl; and X has the meaning given above.

Specific examples of the above monomers include methacryloyloxy ethyl trimethyl ammonium methylsulfate and methacrylamidopropyl trimethyl ammonium chloride.

The cellulose graft copolymers may be prepared by any conventional technique including, for example, by polymerization in water, in water-solvent mixtures and in the dry state, and may be initiated by any conventional method including, for example, mechanical, chemical and irradiative techniques. Preferred methods of preparation include those described in U.S. Pat. Nos. 4,131,576 (issued Dec. 26, 1978 to C. Iovine et al.) and U.S. Pat. No. 4,464,523 (issued Aug. 7, 1984 to D. Neigel et al.), the disclosure of both references being incorporated herein by reference.

Graft copolymers consisting solely of the cellulose and one or more cationic-containing monomers are preferably employed in the processes herein. However, cellulose grafts containing amounts (e.g. up to about 50% by weight of the cationic monomer) of a copolymerizable comonomer suitable for graft copolymerization may be employed as long as the comonomer does not deleteriously affect the ability of the graft copolymer to act as a dye enhancer. Suitable comonomers include acrylic and methacrylic acid, acrylamide, methacrylamide, substituted acrylamides and methacrylamides, vinyl pyrrolidone, styrene sulfonate salts, alkyl or hydroxyalkyl acrylates and methacrylates, etc.

The amount of cationic monomer employed will range from about 5 to 50%, by weight of the final graft copolymer so that a final nitrogen content of about 0.25 to 4.5%, preferably greater than 1%, is provided.

The pretreatment of textile fibers with the cationic cellulose graft copolymers described above before the dyeing process has been found to result in the enhancement of dye fastness and dye add on. Improved color yields as well as the ability to use lower dye bath temperatures and shorter dye bath residence times are other benefits attributable to the pretreatment of textiles with the graft copolymers herein. The amount of graft copolymer employed will, of course, depend on the fabric to be treated and the desired effect to be achieved after dyeing. It is only necessary to use an amount of the graft copolymer necessary to achieve the desired result. This amount may be easily determined by one skilled in the art. Typically amounts of about 0.25 to 2% based on the weight of the bath (OWB) are preferably employed.

The textile substrates which may advantageously be provided with enhanced dyeability by the process of the present invention are natural or regenerated cellulosic fibers, especially cotton. Other textile fibers which may benefit include, for example, natural and synthetic polyamides (e.g., wool, silk and nylon); polyester; synthetic cellulosics (e.g. cellulose acetates); and polyacrylonitrile. Nonhomogeneous blends, especially those of polyester/cotton, also benefit from the use of the present dye enhancers with good dye levelness exhibited. While the cellulose graft copolymers are particularly useful as dye enhancers for woven textile fabrics, the copolymers may be useful when applied to textile substrates in all states of processing suitable for a continuous operation, for example in the form of raw stock, cable, slubbings, filaments, yarns, knitted fabrics and nonwoven articles. The present process is also particularly useful in order to provide dye levelness to various fabric constructions having high surface areas which exhibit high wet pick-up such as pile fabrics, fleece, napped fabrics (e.g., cordouroy), flocked fabric, brushed fabric, and carpets.

The dye enhancers of the present invention may also be employed in a process whereby undyed garments and other finished goods which have been pretreated with the copolymer prior or subsequent to manufacture are capable of being "apparel dyed" according to market demand. The dye enhancers have also been found to be useful in redyeing and overdyeing applications.

The pretreatment of textile fabrics with the cellulose graft copolymer prior to dyeing can be carried out by any conventional technique including the continuous processes of padding, kiss coating, dipping, spraying, and foam application, or by a batchwise exhaust process.

The fabric may be treated solely by the cellulose graft copolymers described herein in a liquid medium such as water. The copolymers may also advantageously be applied in conjunction with other conventional textile finishing agents in a liquid medium including, for example, durable press resins, antistat agents, soil releasing agents, flame retardants, softening agents, and waterproofing agents. The finishing compositions may also additionally contain other conventional ingredients, e.g., stabilizers, resins, thickeners, catalysts, hand builders and surfactants.

Suitable durable press resins include dimethylol dihydroxy ethylene urea resins, triazone formaldehyde resins, urea formaldehyde resins, ethylene urea formaldehyde resins, glyoxal resins, propylene urea formaldehyde resins, carbamate resins, melamine formaldehyde resins, other N-methylol resins, N-methylol ether resins and blends of these resins.

Suitable antistat agents include polyethoxy compounds, quaternary ammonium compounds, and other cationic compounds, ester compounds, polycarboxylic compounds, polyhydroxy compounds, and other anionic compounds, natural gums, starches, starch derivatives, cellulose derivatives, synthetic polymeric compounds and blends of these compounds.

Suitable soil releasing agents include polycarboxylic compounds, polyoxyethylene compounds, polyhydroxy compounds, acrylic polymer emulsions, natural gums, resins, starches, starch derivatives, cellulose derivatives, synthetic polymeric compounds, and blends of these compounds.

Suitable flame retardants include tris-dibromopropyl phosphate, tetrakis-hydroxymethyl phosphonium compounds, N-methylol phosphonamides, organo-phosphorous compounds, nitrogen compounds, phosphorous compounds, antimony compounds, bromine containing compounds, other organic and inorganic flame retardants and blends of these compounds.

Suitable water proofing resins include fluorochemical water repellants, silicone water repellants, metal complexes, waxes, and other hydrophobic agents conventionally used for rendering water repellent fabrics, such as fatty acid salts or polyvalent metal cations.

The finishing agents described above are conventionally used in the art. As such, the particular processing conditions, e.g., temperatures, pressures, concentrations, drying times, fixation or curing temperatures, etc., utilized with the various type finishing agents are well known to the skilled art worker.

The pretreated fibers may be dyed with anionic dyestuffs, direct dyes, acid dyes, reactive dyes and pigments by any conventional manner used in the art including, for example, the exhaust, cold batch, thermosol, or printing method.

The use of the cationic cellulose graft copolymers during the dyeing process is also contemplated herein. When employed during the dyeing process, it should be understood that the graft copolymer must advantageously be applied to the dye bath containing the fabric to be treated prior to introducing the dye or pigment into the bath.

In addition to providing improved dye fastness to a dyed textile substrate, post dye application (top-up) of the graft copolymer has been found to improve the crock resistance (resistance to dye rub-off from the textile surface) of fabric treated therewith.

The invention will now be further illustrated by, but not intended to be limited by, the following examples. The quantities of all ingredients are given in parts by weight and all temperatures are in degrees Celsius unless otherwise indicated.

EXAMPLE 1

This example describes the preparation of a cationic cellulose graft copolymer of dimethyldiallyl ammonium chloride and hydroxyethyl cellulose suitable for use as a dye enhancer in the present invention.

A reactor assembly consisting of a 12 liter flask, a Freidrich condenser, thermometer and agitator is charged with 5250 parts Isopar E (mixed $C_{10}$ avg. isoparaffin available from Exxon Corp.) and 157.5 parts sorbitan mono-oleate. With agitation, 1658 parts of a 2.5 M.S. hydroxyethyl cellulose (2% solution 4000–6000 cps; moisture content 5%) is sifted into the reactor over 15 minutes.

To the above suspension, at 25° C., 846.7 parts of an aqueous solution of N,N-dimethyldiallylammonium chloride at 62% activity is slowly added from a dropping funnel over 45 minutes. When the monomer addition is complete, a solution consisting of: 107.8 parts water, 0.53 parts tetrasodiumethylenediamine tetra acetic acid, 27.3 parts disodium hydrogen phosphate and 9.45 parts ammonium persulfate are slowly added to the suspension, from a dropping funnel over a 15 minute period.

The reaction mixture at this point consists of small uniform spheres containing the cellulose derivative, monomer, catalyst, buffer and water. The concentration of water in the spheres is about 20 wt. %.

The reaction mixture is alternatively evacuated to 20 mm Hg and repressurized to 0.5 psi with nitrogen gas several times. After the last degassing cycle, the reaction is maintained at 0.5 psi with nitrogen and heat is applied to a temperature of 65°–70° C. for 4 hours during which time graft polymerization occurs and the small uniform beads remain intact.

After the required heating time, the batch is cooled to 25° C. and centrifuged at 2000 RPM. The centrifuge cake is washed with 4000 parts of 95% isopropanol and discharged onto perforated trays. The product is dried in a forced draft oven at 40° C. until the volatiles content is 3–8%. The final product (referred to herein as DMDAAC-HEC graft) consists of off-white, uniform, free flowing beads (95% pass through 20 mesh) having the following expected analysis: 2% sol. Viscosity (25° C., 20 RPM) 190 cps.; % Nitrogen (dry basis), 2.05%; Residual Monomer, 1.5%; and I.V. (1N KCl), 3.2 dl/gm.

EXAMPLE 2

This example illustrates the use of a cationic cellulose graft copolymer as a dye enhancer.

A bleached mercerized 100% combed cotton broadcloth of 133×63 construction was prepadded by an aqueous bath containing 0.25–2% of a DMDAAC-HEC graft copolymer (prepared by a procedure similar to that described in Example 1). After passage through the padder, the fabric was partially dried at 107° C. (225° F.) for 45 seconds then pressed dry at 149° C. (300° F.) for 20 seconds.

An untreated control and the pretreated fabrics were pre-wet with tap water and then added simultaneously to an exhaust bath containing 0.5% on weight of fabric (owf) of Direct Diazol Sky Blue 6BA and 1% of nonyl phenol ethoxylate (40) at a 40:1 liquor to goods ratio. With stirring, the bath was heated to and maintained at 88° C. (190° F.) for 30 minutes at a pH of 6.5–7.5, adding 8% on weight of the bath (owb) of magnesium sulfate (Glauber's Salt added as a 10% aqueous solution) at 10 and 20 minutes. The dyed fabrics were rinsed with tap water and pressed dry.

A noticeable increase in color yield was observed by fabric treated with as little as 0.25% owb of the graft copolymer in comparison to the non-pretreated cotton. Increasing dye pick-up and levelness was observed comparable to the amount of graft copolymer applied during pre-padding. In comparison to the fabric prepadded with 1% owb of graft copolymer, fabric prepadded with a greater amount of graft copolymer did not exhibit a significantly deeper shade after dyeing and dye levelness was somewhat less.

The pretreated fabrics also exhibited more fullness of hand after dyeing than the dyed control fabric. This fullness was also durable to washing.

EXAMPLE 3

The pretreated cotton of Example 2 pre-padded with 1% and 2% owb of the graft copolymer were dyed together according to the above procedure. The dye bath contained 0.5% owf of Direct Diazol Sky Blue 6BA at a 40:1 liquor to goods ratio. A non-pretreated cotton control was dyed separately in a similar bath for comparison.

The depth of dye shade of the pre-treated samples was darker than the control. The levelness of dye of the pre-treated fabric with 1% graft copolymer was also better in comparison to the control.

EXAMPLE 4

This example compares the effect on dyeability of fabric pretreatment with a cationic cellulose graft copolymer of the present invention and pretreatment with a cationic cellulose derivative.

Samples of 100% cotton broadcloth were pre-padded according to the procedure of Example 2 employing baths containing 1% owb of the DMDAAC-HEC graft copolymer or 1% owb of a comparative cationic cellulose derivative JR-400 obtained from Union Carbide Corp. having a structure disclosed in U.S. Pat. No. 3,472,840 (issued Oct. 14, 1969 to F. Stone et al.).

The pre-treated samples and non-pre-treated controls were each dyed separately in dye baths A or B according to the procedure of Example 2. Dye Bath A contained the following Direct Dyes in equal amounts: Direct Red 80, Direct Blue 106, and Direct Yellow 2RLSW. Dye Bath B contained the following Acid dyes in equal amounts: Red 167, Blue 80, and Yellow 159. Each bath contained a total of 0.5% owf of a dye combination and had a liquor to goods ratio of 40:1. The following results were observed:

The pre-treated samples dyed in Bath A similarly picked up more of the direct dyes than the non-pre-treated control. The levelness of the cellulose graft pre-treated sample, however, was significantly better than that of the comparative sample.

The pre-treated samples dyed in acid dye-containing Bath B exhibited a much greater difference in shade. Although evenness was good for all samples, the comparative sample had a dye pick up similar to the non-pretreated control while the cellulose graft pre-treated sample exhibited greater dye pick up.

EXAMPLE 5

This example compares the effect on dyeability of fabric pre-treatment with a cationic cellulose graft copolymer employing lower dye temperatures and shorter residence times than employed above.

Samples of 100% cotton broadcloth were pre-padded according to the procedure of Example 2 employing baths containing 0.25–1.0% owb of the DMDAAC-HEC graft copolymer. After passing through the padder, the fabric samples were dried at 110° C. (230° F.) for 120 seconds then pressed dry at 149° C. (300° F.) for 20 seconds.

An untreated control and the pretreated fabrics were then dye separately in baths containing 0.5% owf of Direct Diazol Sky Blue 6BA at a liquor to goods ratio of 40:1. The samples were pre-wet with tap water then added to the dye baths at 49° C. (120° F.). With stirring, the baths were heated to and maintained at 60° C. (140° F.) for 5 minutes. The dyed fabrics were than rinsed with tap water and pressed dry.

The dye intensities of the fabric samples were then compared by an image analysis technique. Each sample was placed adjacent to a black and white control. Employing a constant light source an area containing the dyed sample and the controls (approximately 1.5×1.5 inches) was viewed through a Panasonic Model WV-1550 black and white video camera fitted with a Cosmicar 25 mm. lens. The lens was defocussed to a point where the individual fibers of the fabric were indistinguishable from one another. The image of the viewed area was then digitized in a modified Apple IIe computer utilizing the Quandens software system obtained from FHC, Inc. (P.O. Box 574, Brunswick, Maine 04011) which is used to make intensiometric or densiometric measurements. A scan rate of 5.6 minutes was employed in order to digitalize the viewed area into 48,000 pixels. Four subsets of each sample area (approximately 4,000 pixels each) and one subset of each control area (also approximately 4,000 pixels) were then delineated for dye intensity evaluation. The above procedure was repeated three times, each time viewing a different portion of the dyed fabric sample. The intensiometric values for each dyed sample were compared against a black control (a sheet of black paper) which had an intensiometric value of 120±1 and a white control (an undyed piece of the broadcloth) which had an intensiometric value of 248±1. Thus, the lower the value, the darker the shade of the substrate. The intensiometric values for each dyed sample were as follows:

| Fabric Pre-treatment | Intensiometric Value of Dyed Fabric |
|---|---|
| Control-none | 190 ± 1 |
| 0.25% DMDAAC-HEC | 173 ± 1 |
| 0.5% DMDAAC-HEC | 170 ± 1 |
| 1.0% DMDAAC-HEC | 166 ± 1 |

The results show that the cationic cellulose graft treated samples picked up more dye in comparison to the untreated control.

EXAMPLE 6

This example illustrates the use of the cationic cellulose graft copolymer in conjunction with a durable press resin.

Samples of 100% cotton broadcloth were padded in a resin bath containing 1% or 2% owb of DMDAAC-HEC graft copolymer and 7% owb of PROTOREZ® SRR (a pre-catalyzed low-formaldehyde N-methylol ether resin obtainable from National Starch and Chemical Corporation). After passage through the padder, the fabric was partially dried at 107° C. (225° F.) for 45 seconds, then pressed dry at 149° C. (300° F.) for 20 seconds. Control samples were padded as above in similar baths containing only the resin. All samples were cured in a forced draft oven at 171° C. (340° F.) for 1.5 minutes. The fabrics were then dyed in pairs (graft treated with control) in the dye baths of Example 3 according to the procedure of Example 2. The results showed that the graft copolymer is compatible in a resin bath and that the addition of the graft copolymer in the prepadding provided fabrics which exhibited greater dye pick up in comparison to the resin-only prepadded control.

EXAMPLE 7

Similar results were observed when the procedure of Example 6 was repeated employing resin baths containing 1 or 2% owb of the graft copolymer, 5% owb of PROTOREZ® RL-5632 (a low-formaldehyde N-methylol ether resin) and 1.4% owb of CURITE® 5361 (an activated magnesium chloride catalyst) which are both obtainable from National Starch and Chemical Corporation.

Variations may be made in the proportions, procedures, and materials without departing from the scope of this invention which is defined by the following claims.

We claim:

1. A method for improving the dyeing properties of a textile substrate, which comprises treating the textile substrate before, during or after dyeing, with a composition comprising a cationic cellulose graft copolymer prepared by reaction of a cellulose substrate for the cellulose graft copolymer and a cationic monomer having the formula

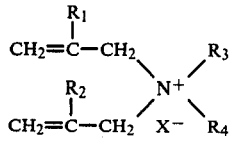

wherein $R_1$ and $R_2$ are independently hydrogen or $C_1$–$C_3$ alkyl;

$R_3$ and $R_4$ are independently hydrogen, phenyl, or $C_1$–$C_{16}$ alkyl; and X is an anion;

or having the formula

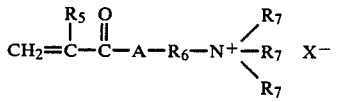

wherein

A is —O— or —NH—;

$R_5$ is hydrogen or $C_1$–$C_3$ alkyl;

$R_6$ is $C_1$–$C_{12}$ alkylene or $C_1$–$C_{12}$ hydroxyalkylene;

$R_7$ is phenyl or $C_1$–$C_3$ alkyl; and

X is an anion.

2. The method of claim 1, wherein the cellulose substrate for the cellulose graft copolymer is selected from the group consisting of cellulose, hydroxyethyl cellulose, hydroxypropyl cellulose, methyl cellulose, ethyl cellulose, carboxymethyl cellulose and carboxymethylhydroxyethyl cellulose.

3. The method of claim 1, wherein the cationic monomer has the formula

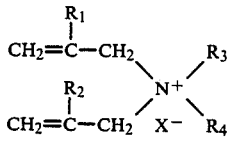

wherein $R_1$ and $R_2$ are independently hydrogen or $C_1$–$C_3$ alkyl;

$R_3$ and $R_4$ are independently hydrogen, phenyl, or $C_1$–$C_{16}$ alkyl; and X is an anion.

4. The method of claim 3, wherein $R_1$ and $R_2$ are hydrogen and $R_3$ and $R_4$ are $C_1$–$C_4$ alkyl.

5. The method of claim 1, wherein the cationic monomer has the formula

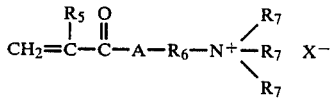

wherein

A is —O— or —NH—;

$R_5$ is hydrogen or $C_1$–$C_3$ alkyl;

$R_6$ is $C_1$–$C_{12}$ alkylene or $C_1$–$C_{12}$ hydroxyalkylene;

$R_7$ is phenyl or $C_1$–$C_3$ alkyl; and

X is an anion.

6. The method of claim 1, wherein the cationic monomer is replaced with up to about 50% by weight of copolymerizable comonomer selected from the group consisting of acrylic and methacrylic acid, alkyl or hydroxyalkyl acrylates and methacrylates, acrylamide, methacrylamide, vinyl pyrrolidine and styrene sulfonate salts.

7. The method of claim 1, wherein the textile substrate is selected from the group consisting of a natural or regenerated cellulosic fiber, a polyamide, a polyester, a polyacrylonitrile; and blends thereof.

8. The method of claim 7, wherein the textile substrate is cotton or a polyester/cotton blend.

9. The method of claim 1, wherein the substrate is dyed with an anionic dyestuff, a direct dyestuff, an acid dyestuff, or a reactive dyestuff.

10. An undyed textile substrate to which has been applied the pretreatment step of the method according to claim 1.

11. The textile substrate of claim 10, wherein the substrate is a garment.

12. A process for dyeing a textile fibers substrate comprising the step of applying an aqueous dye solution to the textile fibers, said fibers having been treated with a cationic cellulose graft copolymer prepared by reaction of a cellulose substrate for the cellulose graft copolymer and a cationic monomer having the formula

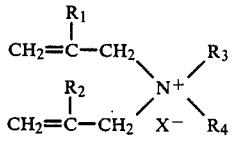

wherein $R_1$ and $R_2$ are independently hydrogen or $C_1$–$C_3$ alkyl;

$R_3$ and $R_4$ are independently hydrogen, phenyl, or $C_1$–$C_{16}$ alkyl; and X is an anion; or having the formula

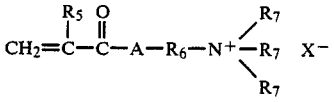

wherein

A is —O— or —NH—;

$R_5$ is hydrogen or $C_1$–$C_3$ alkyl;

$R_6$ is $C_1$–$C_{12}$ alkylene or $C_1$–$C_{12}$ hydroxyalkylene;

$R_7$ is phenyl or $C_1$–$C_3$ alkyl; and

X is an anion.

13. The process of claim 12, wherein the cellulose substrate for the cellulose graft copolymer is selected from the group consisting of cellulose, hydroxyethyl cellulose, hydroxypropyl cellulose, methyl cellulose, ethyl cellulose, carboxymethyl cellulose and carboxymethylhydroxyethyl cellulose.

14. The process of claim 12, wherein the cationic monomer has the formula

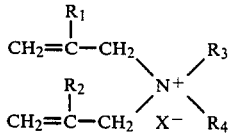

wherein $R_1$ and $R_2$ are independently hydrogen or $C_1$–$C_3$ alkyl;

$R_3$ and $R_4$ are independently hydrogen, phenyl, or $C_1$–$C_{16}$ alkyl; and X is an anion.

15. The process of claim 14, wherein the cellulose substrate for the cellulose graft copolymer is hydroxyethyl cellulose and $R_1$ and $R_2$ of the cationic monomer are hydrogen and $R_3$ and $R_4$ are $C_1$–$C_4$ alkyl.

16. The process of claim 12, wherein the textile substrate is selected from the group consisting of a cellulosic, a polyamide, a polyester, a polyacrylonitrile; and blends thereof.

17. The process of claim 16, wherein the textile substrate is cotton or a polyester/cotton blend.

18. The process of claim 12, wherein the dye solution comprises a dye selected from the group consisting of an anionic, direct, acid, or reactive dye.

19. The process of claim 18, wherein the dye is a direct or an acid dye.

20. An overdyeing process according to the process of claim 12, wherein the fibers which are treated with said graft copolymer are dyed fibers.

21. A composition suitable for treating textile substrates comprising (a) a fabric finishing agent selected from the group consisting of durable press resins, antistat agents, soil releasing agents, flame retardants, softening agents, and waterproofing agents and (b) a cationic cellulose graft copolymer prepared by reaction of a cellulose substrate for the cellulose graft copolymer and a cationic monomer having the formula

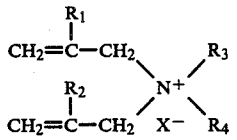

wherein $R_1$ and $R_2$ are independently hydrogen or $C_1$–$C_3$ alkyl;

$R_3$ and $R_4$ are independently hydrogen, phenyl, or $C_1$–$C_{16}$ alkyl; and X is an anion;

or having the formula

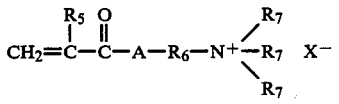

wherein

A is —O— or —NH—;

$R_5$ is hydrogen or $C_1$–$C_3$ alkyl;

$R_6$ is $C_1$–$C_{12}$ alkylene or $C_1$–$C_{12}$ hydroxyalkylene;

$R_7$ is phenyl or $C_1$–$C_3$ alkyl; and

X is an anion.

22. The composition of claim 21, wherein the cellulose substrate of the graft copolymer is selected from the group consisting of cellulose, hydroxyethyl cellulose, hydroxypropyl cellulose, methyl cellulose, ethyl cellulose, carboxymethyl cellulose and carboxymethylhydroxyethyl cellulose and the cationic monomer has the formula

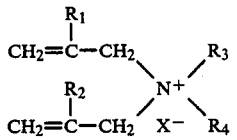

wherein $R_1$ and $R_2$ are independently hydrogen or $C_1$–$C_3$ alkyl;

$R_3$ and $R_4$ are independently hydrogen, phenyl, or $C_1$–$C_{16}$ alkyl; and X is an anion.

23. The composition of claim 22, wherein the durable press resin is an N-methylol ether resin, and the cationic cellulose graft copolymer is the graft copolymer of hydroxyethyl cellulose and the cationic monomer where $R_1$ and $R_2$ of the cationic monomer are hydrogen and $R_3$ and $R_4$ are $C_1$–$C_4$ alkyl.

24. A composition suitable for treating textile substrates comprising:

(a) a cationic cellulose graft copolymer prepared by reaction of a cellulose substrate for the cellulose graft copolymer and a cationic monomer; and at least one fabric finishing agent selected from the group:

(b) dimethylol dihydroxy ethylene urea resin, urea formaldehyde resin, triazone formaldehyde resin, melamine formaldehyde resin, glyoxal resin, carbamate resin, an N-methylol resin, polyalkylene oxide compound, polycarboxylic compound, polyhydroxy compound, acrylic polymer emulsion, a fluorochemical water repellant, a silicone water repellant, wax, and phosphorous-containing flame retardant, wherein said cationic monomer employed in the preparation of the cellulose graft copolymer has the formula

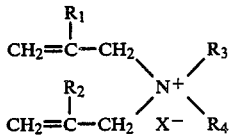

wherein $R_1$ and $R_2$ are independently hydrogen or $C_1$–$C_3$ alkyl;

$R_3$ and $R_4$ are independently hydrogen, phenyl, or $C_1$–$C_{16}$ alkyl; and X is an anion; or having the formula

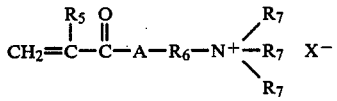

wherein

A is —O— or —NH—;

$R_5$ is hydrogen or $C_1$–$C_3$ alkyl;

$R_6$ is $C_1$–$C_{12}$ alkylene or $C_1$–$C_{12}$ hydroxyalkylene;

$R_7$ is phenyl or $C_1$–$C_3$ alkyl; and

X is an anion.

25. The composition of claim 24 further comprising a stabilizer, a thickener, a catalyst, or a surfactant.

26. The composition of claim 24 wherein the urea formaldehyde resin is an ethylene urea formaldehyde resin or a propylene urea formaldehyde resin; the N-methylol resin is an N-methylol ether resin; the polyalkylene oxide compound is a polyoxyethylene compound; the cationic compound is a quaternary ammonium compound; the polyhydroxy compound is a starch, a starch derivative, a natural gum, or a cellulose derivative; and the phosphorous compound is tris-dibromopropylphosphate, a tetrakis-hydroxymethyl phosphonium compound, or an N-methylol phosphonamide.

* * * * *